United States Patent [19]

Wingo, Jr. et al.

[11] Patent Number: 5,035,009

[45] Date of Patent: Jul. 30, 1991

[54] PROTECTIVE HELMET AND LINER

[75] Inventors: James C. Wingo, Jr., Stafford, Tex.; Nelson Kraemer, Mt. Prospect, Ill.

[73] Assignee: Riddell, Inc., Chicago, Ill.

[21] Appl. No.: 589,387

[22] Filed: Sep. 27, 1990

[51] Int. Cl.[5] ..... A42B 3/00

[52] U.S. Cl. ..... 2/414; 2/425

[58] Field of Search ..... 2/410, 411, 414, 422, 2/425, 190; 181/126

[56] References Cited

U.S. PATENT DOCUMENTS

| | | | |
|---|---|---|---|
| 3,055,013 | 9/1962 | Aileo | 2/414 |
| 3,153,792 | 10/1964 | Marietta | 2/414 |
| 3,364,499 | 1/1968 | Kwoka | 2/414 |
| 3,609,764 | 10/1971 | Morgan | 2/414 |
| 3,673,609 | 7/1972 | DeSimone | 2/414 |
| 3,882,547 | 5/1975 | Morgan | 2/414 |
| 4,133,055 | 1/1979 | Zebuhr | 2/411 |
| 4,345,338 | 8/1982 | Frieder, Jr. et al. | 2/414 |
| 4,432,099 | 2/1984 | Grick et al. | 2/414 |
| 4,566,137 | 1/1986 | Gooding | 2/425 |
| 4,627,114 | 12/1986 | Mitchell | 2/414 |

FOREIGN PATENT DOCUMENTS

| | | | |
|---|---|---|---|
| 346608 | 12/1989 | European Pat. Off. | 2/411 |
| 3337599 | 4/1985 | Fed. Rep. of Germany | 2/410 |

*Primary Examiner*—Werner H. Schroeder
*Assistant Examiner*—Michael A. Neas
*Attorney, Agent, or Firm*—Ben D. Tobor

[57] ABSTRACT

A protective helmet and liner therefor includes a sheet of sound deadening material which fits between impact force absorbing pad structures disposed on the interior of the protective helmet.

20 Claims, 4 Drawing Sheets

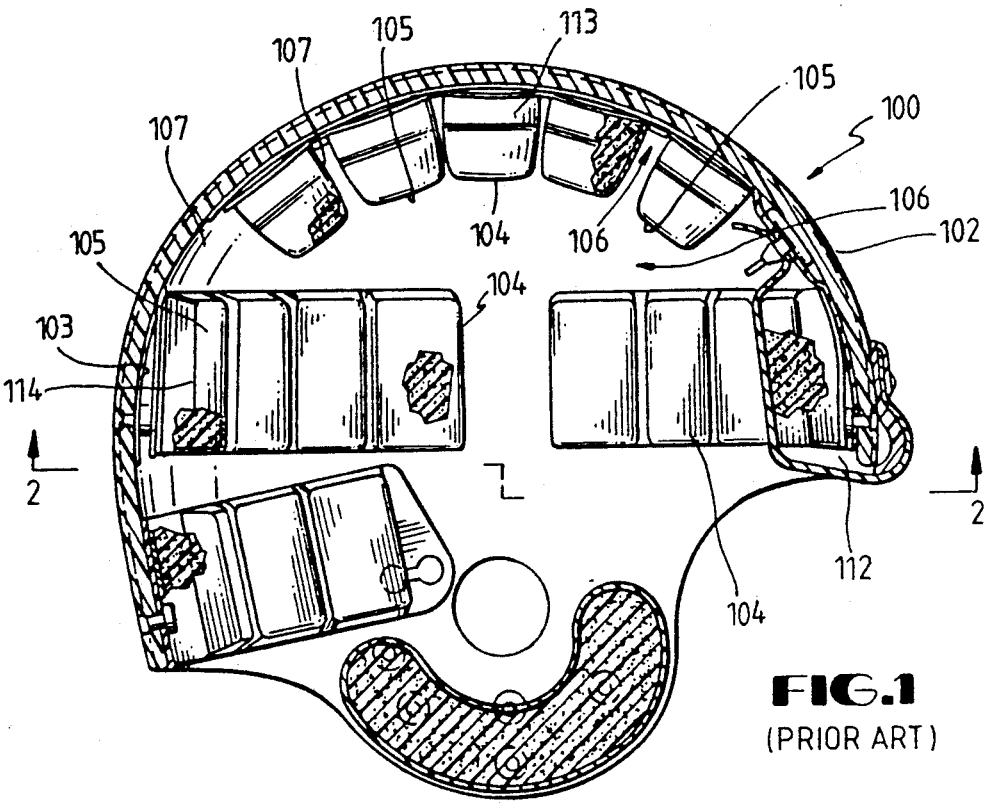
FIG.1
(PRIOR ART)
FIG.2
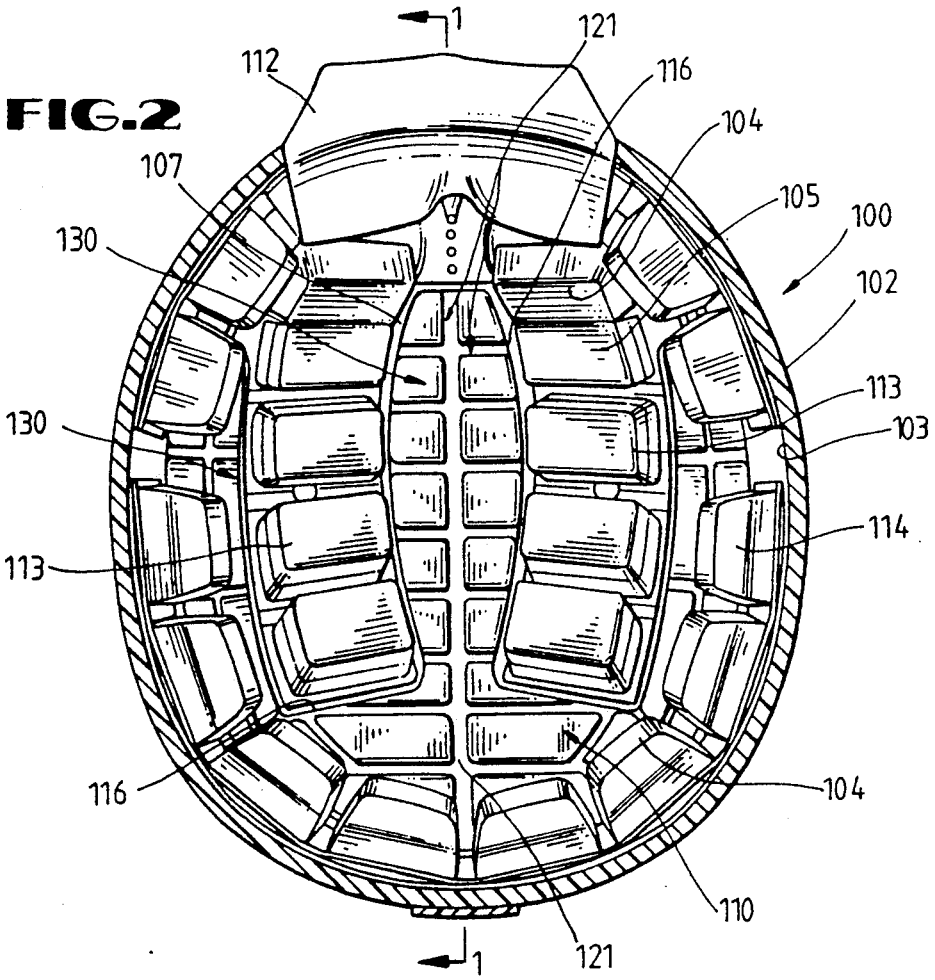

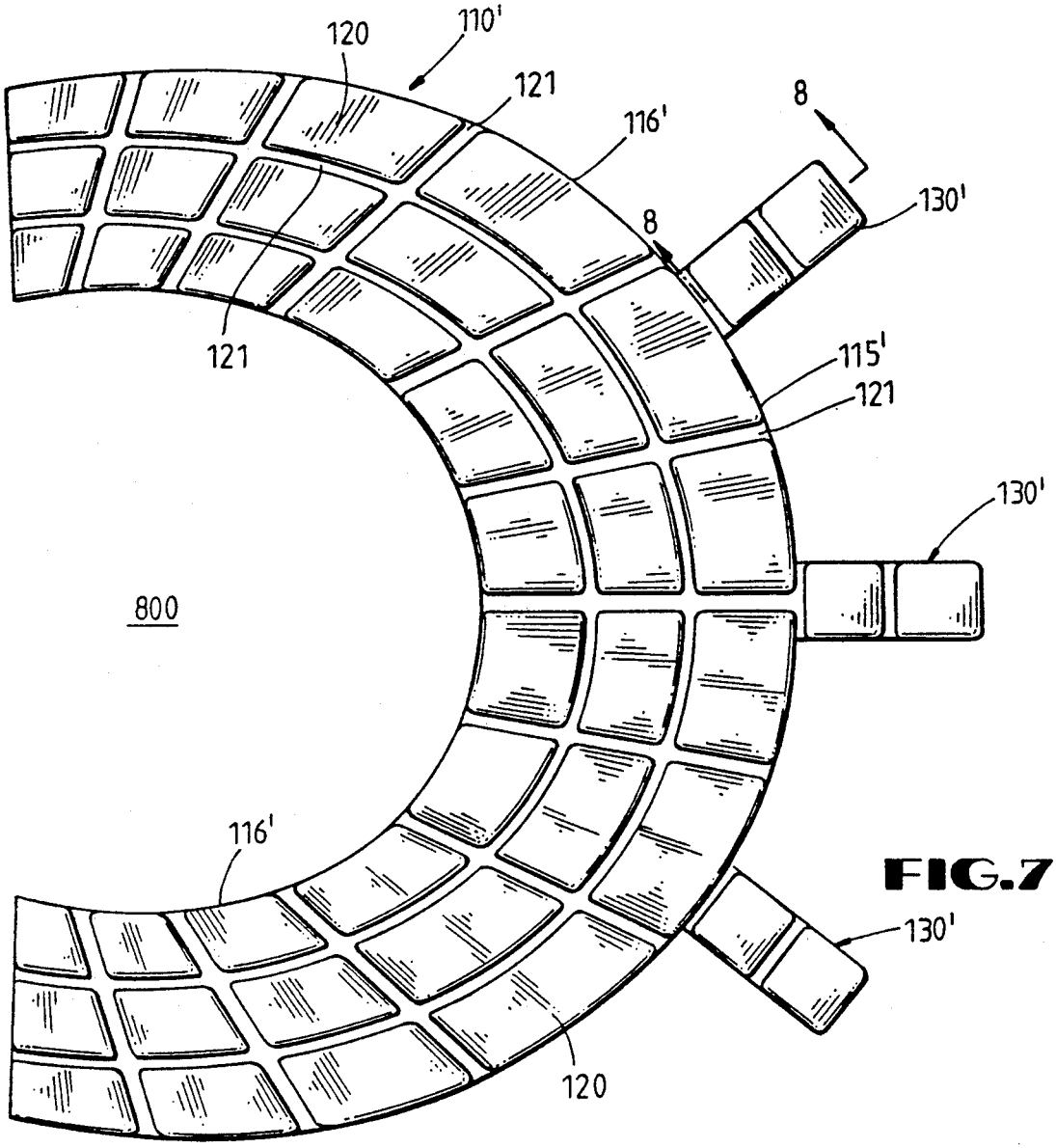
FIG.7
FIG.8
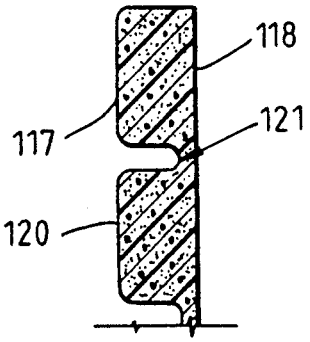

PROTECTIVE HELMET AND LINER

1. Field of the Invention

The invention relates to a protective helmet and liner, particularly for a protective helmet and liner for individuals playing in the sport of football.

2. Description of the Prior Art

Various types of pad structures for protective helmets, such as football helmets, hardhats, crash helmets, and the like, are disposed on an interior surface of the helmet in order to absorb impact forces, upon the helmet being struck, to protect the wearer of the helmet. Certain pad structures have been proposed for use with protective helmets, wherein the pad structures are not disposed over the entire interior surface of the protective helmet. Examples of two such protective helmets are shown and described in U.S. Pat. No. 3,609,764, issued Oct. 5, 1971, to Gerard E. Morgan, and U.S. Pat. No. 3,882,547, issued May 13, 1975, to Gerard E. Morgan. Each of the foregoing patents describes a pad structure for use in protective helmets which provides impact force absorption and has the ability to be sized to fit the various shaped heads of individual wearers of the helmet. The impact force absorption and sizing ability of the helmets described in the two foregoing patents are achieved without the pad structures covering the entire interior surface of the helmet, but rather by having the pad structures disposed in a spaced relationship from each other, with portions of the interior surface of the helmet being exposed in the spaces between the pad structures.

Because portions of the interior surfaces of some of the protective helmets of the prior art are exposed, and since protective helmets are usually made from a rigid plastic material, some wearers of these helmets have expressed dissatisfaction with the helmets because they sometimes have difficulty hearing while wearing the protective helmets due to vibrational forces, causing noise and echo effects from voices and the sounds of impact when the helmet is struck. It is also believed that because some of the interior surfaces of the protective helmet are exposed, such surfaces may be subject to degradation caused by the interior surface being contacted, over a period of time, by various types of chemicals contained in hair preparations worn by the wearers of the protective helmet. Additionally, such exposed interior surfaces of these protective helmets may become unsightly because of exposure to the same hair preparations, as well as other types of dirt and grime which can become embedded on such interior surfaces because of the entry of dirt, etc. into the interior of the protective helmet. Because of the design and shape of some of the pad structures disposed in the interior surface of these protective helmets, it can be difficult to readily clean out the inside surface of the protective helmet.

Accordingly, prior to the development of the present protective helmet and liner, there has been no protective helmet, having a plurality of pad structures disposed upon the interior surface of the helmet in a spaced relationship, which: reduces noise caused by vibrational forces and echo effects from voices and impact forces upon the helmet; protects the exposed interior surface of the helmet from potential degradation due to long term exposure to chemicals contained in hair preparations; and is able to be readily cleaned and maintained to be sanitary and have a clean appearance. Therefore, the art has sought a protective helmet, which utilizes a plurality of pad structures, disposed in a spaced relationship upon the interior surface of the helmet, which: reduces noise caused by vibrational forces and echo effects from voices and impact forces upon the helmet; protects against potential degradation of the interior surface of the helmet caused by long term exposure to chemicals contained in various hair preparations; and permits the interior surface of the helmet to be readily cleaned and able to maintain a clean and sanitary appearance.

SUMMARY OF THE INVENTION

In accordance with the invention, the foregoing advantages have been achieved through the present replaceable, removable liner for use in a protective helmet having an interior surface, portions of the interior surface having pad structures disposed thereon in a spaced relationship, and other portions of the interior surface being exposed in the spaces between the pad structures. The liner in accordance with the present invention includes: at least one sheet of sound deadening material having a periphery surface which conforms to, and fits within, the spaces between the pad structures; and the at least one sheet of material has an upper and a lower surface, the lower surface adapted to be disposed adjacent the interior surface of the helmet, the upper surface adapted to be spaced from the interior surface of the helmet, the upper surface of the sheet of material being spaced a smaller distance from the interior surface of the helmet than the outer surfaces of the pad structures, whereby the liner may be inserted in the helmet and reduce the transmission of sound within the helmet.

A further feature of the present invention is that the sound deadening material may be a plastic material, which may be a plastic foam material. Another feature of the present invention is that the plastic foam material may be a closed cell plastic foam material, which may be cross-linked polyethylene. A further feature of the present invention is that the at least one sheet of sound deadening material may have a plurality of raised projections on its upper surface, and these projections may be spaced from adjacent projections and separated therefrom by a portion of the at least one sheet of material having a reduced thickness, and the sheet of material may be flexed and bent along the reduced thickness portions of the sheet, whereby the liner readily conforms to, and fits within, the spaces between the pad structures.

An additional feature of the present invention is that the liner may be formed of a single, integral sheet of sound deadening material. Another feature of the present invention is that the at least one sheet of sound deadening material may include at least one positioning member extending outwardly from the periphery surface, the at least one positioning member adapted to be disposed between some of the pad structures to position the liner within the protective helmet. A further feature of the present invention is that there may be three positioning members.

In accordance with another aspect of the invention, the foregoing advantages have been achieved through the present protective helmet. The protective helmet, in accordance with the present invention, includes: a helmet shell having an interior surface, portions of the interior surface having pad structures, having outer surfaces spaced from the interior surface of the helmet shell, disposed thereon in a spaced relationship, other portions of the interior surface being exposed in the spaces between the pad structures; and a replaceable, removable liner for the helmet shell, the liner including at least one sheet of sound deadening material having a periphery surface which conforms to, and fits within, the spaces between the pad structures, and the at least one sheet of material having an upper and lower surface, the lower surface adapted to be disposed adjacent the interior surface of the helmet, the upper surface adapted to be spaced from the interior surface of the helmet, the upper surface of the sheet of material being spaced a smaller distance from the interior surface of the helmet than the outer surfaces of the pad structures, whereby the liner may be inserted in the helmet shell and reduce the transmission of sound within the helmet shell.

A further feature of the present invention is that the sound deadening material may be a plastic material, and may be a closed cell plastic foam material. A further feature of the present invention is that the at least one sheet of sound deadening material may have a plurality of raised projections on its upper surface, and each projection is spaced from adjacent projections and separated therefrom by a portion of the at least one sheet of material having a reduced thickness, and the sheet of material may be flexed and bent along the reduced thickness portions of the sheet, whereby the liner readily conforms to, and fits within the spaces between the pad structures.

Another feature of the present invention is that the at least one sheet of sound deadening material may include at least one positioning member extending outwardly from the periphery surface, the at least one positioning member adapted to be disposed between some of the pad structures to position the liner within the protective helmet.

The protective helmet and liner of the present invention, when compared with previously proposed prior art protective helmets, has the advantages of: being able to reduce noise caused by vibrational forces and echo effects from voices and impact forces within the helmet shell; protecting the interior of the helmet shell from potential degradation of the helmet shell from chemicals contained in hair preparations worn by the wearers of the protective helmets; provides the interior of the protective helmet with a clean and sanitary appearance; and assisting in the cleaning of the interior surface of the protective helmet.

BRIEF DESCRIPTION OF THE DRAWINGS

In the Drawings:

FIG. 1 is a partial cross-sectional view of a prior art protective helmet;

FIG. 2 is a partial cross-sectional view taken along lines 2—2 of FIG. 1, the protective helmet being provided with a liner in accordance with the present invention;

FIG. 7 is a plan view of a liner in accordance with the present invention;

FIG. 8 is a cross-sectional view taken along lines 8—8 of FIG. 6.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
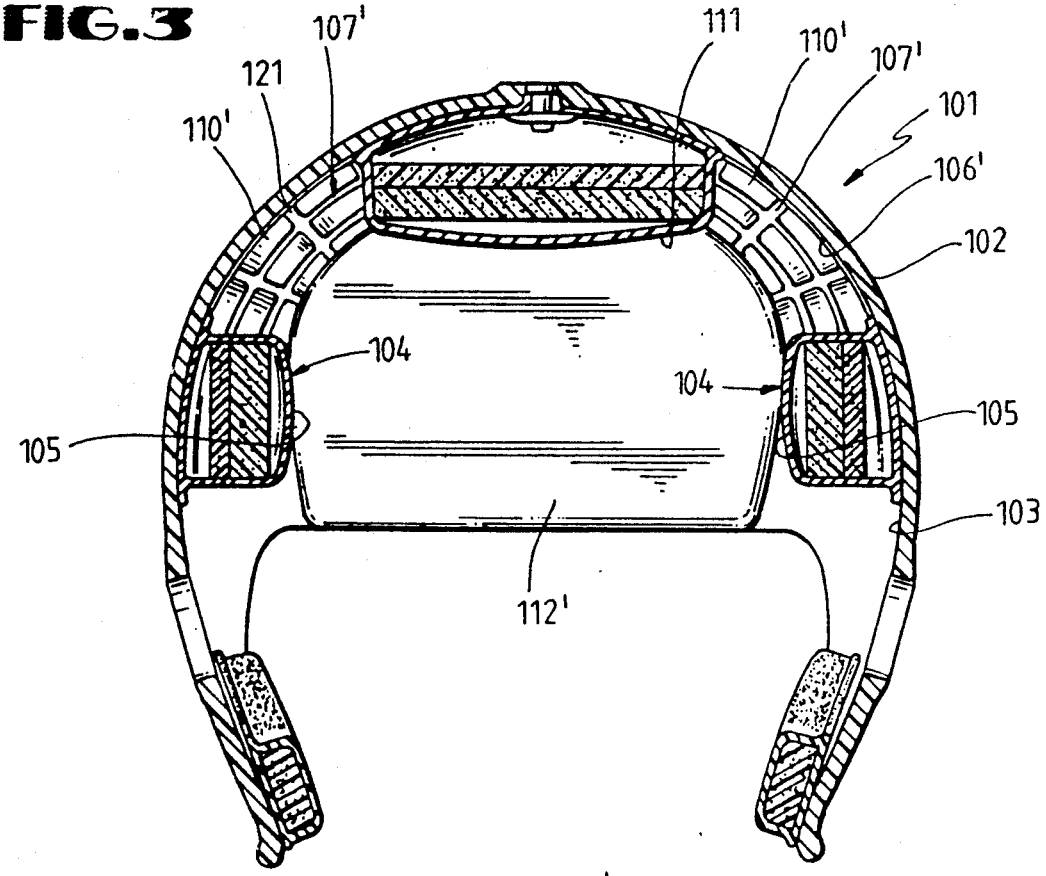
FIG. 3 is a partial cross-sectional view of a helmet taken along lines 3—3 of FIG. 4 in accordance with the present invention.
Figure 4:
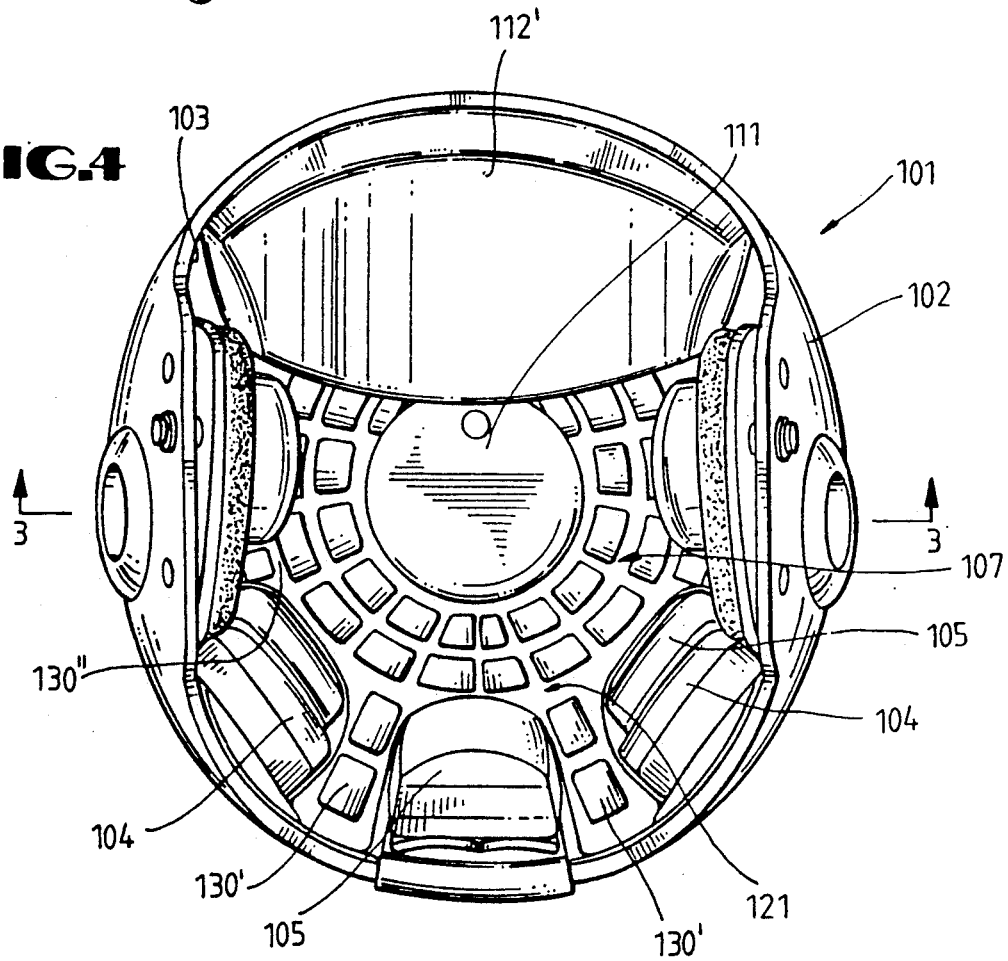
FIG. 4 is a bottom view of a protective helmet, in accordance with the present invention, and provided with the liner of the present invention.

In FIGS. 1–4, two examples of protective helmets 100, 101 are illustrated. Protective helmets 100, 101 are particularly adapted for use in the sport of football. Protective helmet 100 generally corresponds to the protective helmet described and disclosed in U.S. Pat. No. 3,882,547, which patent is incorporated herein by reference. Helmet 101 of FIGS. 3 and 4 is substantially similar to the helmet disclosed in U.S. Pat. No. 3,609,764, which patent is incorporated herein by reference. For ease of description, the same reference numerals will be used to describe the same components found in helmets 100, 101, and components similar in design and function will be denoted by primed reference numerals. Each helmet, 101, generally includes a conventional helmet shell 102, formed of a material normally used for such helmet shells, the common material being a relatively stiff plastic material. Each shell 102 has an interior surface 103, portions of the interior surface 102 having a plurality of pad structures 104 disposed thereon in a spaced relationship. Each pad structures 104 has an outer surface 105 spaced from the interior surface 103 of helmet shell 102. Protective helmets 100, 101 have other portions 106, 106' (FIGS. 1 and 3) of the interior surface 103 of shell 102 being exposed in the spaces 107, 107' between the pad structures 104. As will be hereinafter described in greater detail, each protective helmet, 100, 101 is provided with a replaceable, removable liner 110, 110'. The helmet 100 of FIG. 1 is illustrated without having liner 110 inserted therein, whereas liner 110 is illustrated in FIG. 2 as being disposed within helmet 100 as will be hereinafter described in greater detail. In FIG. 3, liner 110' is illustrated as being disposed within helmet 101 as is the case in FIG. 4.

The helmets 100, 101 of FIGS. 1–4, in addition to pad structures 104, have a crown pad 111 (FIGS. 3 and 4) and a forehead pad 112, 112', the crown pad 111 being the same, or similar to that disclosed in U.S. Pat. No. 3,609,764, and the forehead pads 112, 112' being a conventional pad structure, adapted to be disposed between the forehead of the wearer and the front of the helmet 100, 101.

Figure 5:
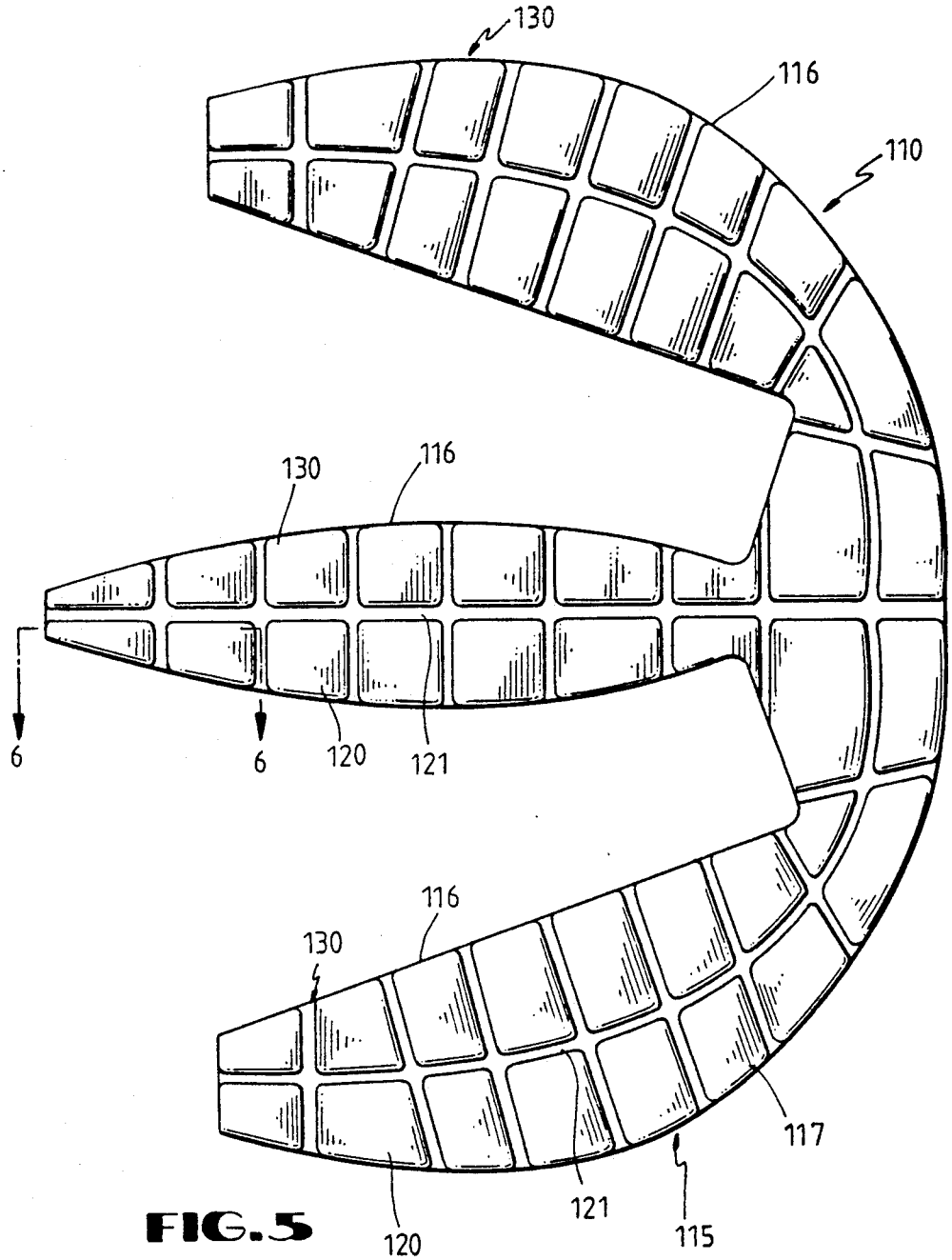
FIG. 5 is a plan view of a liner in accordance with the present invention.
Figure 6:
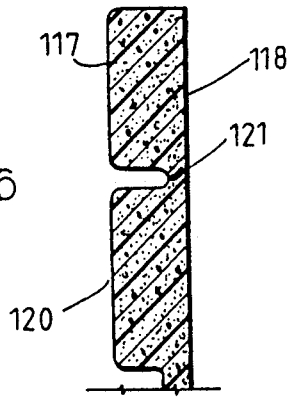
FIG. 6 is a cross-sectional view taken along lines 6—6 of FIG. 5.

With reference to FIGS. 2, 5, and 6, liner 110 is seen to include at least one sheet 115 of sound deadening material having a periphery surface 116 which conforms to, and fits within, the spaces 107 between pad structures 104. The at least one sheet 115 of sound deadening material has an upper and a lower surface 117, 118, the lower surface 118 being adapted to be disposed adjacent the interior surface 103 of the helmet shell 102. The upper surface 117 of the at least one sheet 115 of sound deadening material is adapted to be spaced from the interior surface 103 of the helmet shell 102. The height of the at least one sheet 115 of sound deadening material is less than the height of pad structures 104, whereby the upper surface 117 of the sheet 115 of sound deadening material is spaced a smaller distance from the interior surface 103 of the helmet shell 102 than the outer surfaces 105 of the pad structures 104. In this regard, it should be noted that liners 110, 110' are not intended, nor designed, to absorb impact forces, and it is not contemplated that the skull of the wearer of helmets 100, 101 will ever contact liners 110, 110', except possibly for an extremely short period of time upon a substantial impact force being encountered. Rather, any impact forces sustained are intended to be absorbed by pad structures 104, 111, 112 and 112'. It is more likely that only the hair of the wearer of helmets 100, 101 might contact the upper surface 117 of liners 110, 110'. It is intended that liners 110, 110', after being inserted into helmets 100, 101, the sound deadening material forming liners 110, 110' will serve to reduce within helmets 100, 101 the noise caused by vibrational forces and by helmets 100, 101 sustaining an impact, as well as reduce the echo effects of sound within helmets 100, 101. Although not illustrated for drawing clarity in FIG. 2, the periphery surfaces 116 of liner 110 snugly fits within the spaces 107 between pad structures 104, with a slight frictional fit, whereby such slight frictional fit serves to hold liner 110 in place. Preferably, liner 110 does not extend below the row 114 (FIGS. 1 and 2) of pad structures 104, but rather is disposed above row 114 of pad structures 104 and between the rows 113 of pad structures 104, as illustrated in FIG. 2.

Similarly, with respect to FIGS. 3, 4, 7, and 8, liner 110' includes at least one sheet 115' of sound deadening material having a periphery surface 116' which conforms to, and fits within, the spaces 107' between the pad structures 104. The liner 110' also has an upper and a lower surface 117, 118, and the thickness of liner 110' is the same as that of liner 110 previously described. Liner 110' fits snugly within spaces 107 disposed between pad structures 104 and the forehead pad 112' and crown pad 111, as seen in FIG. 4.

With reference to FIGS. 5–8, liners 110, 110', are preferably formed of a sound deadening material which is a plastic material. A plastic material not only provides the desired sound dampening and deadening characteristics required, but is also readily inserted within helmets 100, 101, and can be snugly received within spaces 107, with a slight frictional fit, as previously described. The plastic material may preferably be a plastic foam material which preferably may be a closed cell plastic foam material. One suitable example of such a closed cell plastic foam material is a cross-linked polyethylene closed cell foam. Such material further has the ability to be readily wiped off to be cleaned, when necessary, as well as does not have a tendency to absorb any moisture. However, any other plastic material or plastic foam material having the requisite sound dampening, flexibility, and liquid non-absorption characteristics may be utilized. Thus, liners 110, 110', are able to provide a clean and sanitary appearance for the interior of helmets 100, 110, and in particular prevent foreign substances, such as chemicals contained in hair preparations worn by the wearer of helmets 100, 110, from contacting the interior surface 103 of helmet shell 102. Furthermore, when desired, the liners 110, 110', may be readily removed from helmets 100, 101, and a new liner 110, 110' may be readily inserted.

Still with reference to FIG. 5–8, each at least one sheet 115, 115' of sound deadening material may have a plurality of raised projections 120 disposed on the upper surface 117 of sheets 115, 115'. Each projection 120 is preferably spaced from adjacent projections 120 and separated therefrom by a portion of the at least one sheet 115, 115' of sound deadening material having a reduced thickness portion 121, whereby the at least one sheet of material 115, 115' may be flexed and bent along the reduced thickness region 121 of sheets 115, 115'. Thus the liners 110, 110' may readily conform to, and fit within, the spaces 107 between the pad structures 104, in the case of helmet 100 of FIGS. 1 and 2, or within the spaces 107 between the pad structures 104, 112', and 111 in the case of the helmet 101 of FIGS. 3 and 4. Preferably, liners 110, 110' are formed as a single, integral sheet 115, 115', of sound deadening material by a compression molding process. Although raised projections 120 are illustrated as having a generally rectangular cross-sectional configuration, they could have many other cross-sectional configurations.

Preferably, each sheet 115, 115' of sound deadening 130' adapted to be disposed between some of the pad structures 104 to position the liner 110, 110' within the protective helmets 100, 101. Preferably as seen in FIGS. 5 and 7, each liner 110, 110' is provided with three positioning members 130. The positioning members 130 of liner 110 are seen to be disposed between rows 113 of pad structures 104, and between rows 113 and 114 of pad structures 104, as seen in FIG. 2. Positioning members 130' of liner 110' are seen to be disposed between pad structures 104, as seen in FIG. 4.

It is to be understood that the invention is not limited to the exact details of construction, operation, exact materials, or embodiments shown and described as obvious modifications and equivalents will be apparent to one skilled in the art; for example, the adjacent projections on the liners can have different heights. Accordingly, the invention is therefore to be limited only by the scope of the appended claims.

We claim:

1. For use in a protective helmet having an interior surface, portions of the interior surface having pad structures having outer surfaces spaced from the interior surface of the helmet and disposed thereon in a spaced relationship, and other portions of the interior surface being exposed in the spaces between the pad structures, a replaceable, removable liner comprising:

at least one sheet of sound deadening material having a peripheral surface conforming to, and fitting within, the spaces between the pad structures; and the at least one sheet of material having an upper and a lower surface, the lower surface being disposed adjacent the interior surface of the helmet, the upper surface being spaced from the interior surface of the helmet, the upper surface of the at least one sheet of material being spaced a smaller distance from the interior surface of the helmet than the outer surfaces of the pad structures, whereby the liner may be inserted in the helmet and reduce the transmission of sound within the helmet.

2. The liner of claim 1, wherein the sound deadening material is a plastic material.

3. The liner of claim 2, wherein the plastic material is a plastic foam material.

4. The liner of claim 3, wherein the plastic foam material is a closed cell plastic foam material.

5. The liner of claim 4, wherein the closed cell plastic foam material is cross-linked polyethylene.

6. The liner of claim 1, wherein the at least one sheet of sound deadening material has a plurality of raised projections on its upper surface.

7. The liner of claim 6, wherein each projection is spaced from adjacent projections and separated therefrom by a portion of the at least one sheet having a reduced thickness, and the sheet of material may be flexed and bent along the reduced thickness portions of the sheet, whereby the liner readily conforms to, and fits within, the spaces between the pad structures.

8. The liner of claim 7 wherein the liner is formed of a single, integral sheet of sound deadening material.

9. The liner of claim 1, wherein the at least one sheet of sound deadening material includes at least one positioning member extending outwardly from the peripheral surface, the at least one positioning member being disposed between some of the pad structures to position the liner within the protective helmet.

10. The liner of claim 9, wherein there are three peripheral positioning members.

11. A protective helmet, comprising:

a helmet shell having an interior surface, portions of the interior surface having pad structures having outer surfaces spaced from the interior surface of the helmet shell and disposed thereon in a spaced relationship, other portions of the interior surface being exposed in the spaces between the pad structure;

a replaceable, removable liner for the helmet shell, the liner including at least one sheet of sound deadening material having a peripheral surface conforming to, and fitting within, the spaces between the pad structures; and the at least one sheet of material having an upper and a lower surface, the lower surface being disposed adjacent the interior surface of the helmet shell, the upper surface being spaced from the interior surface of the helmet shell, the upper surface of the at least one sheet of material being spaced a smaller distance from the interior surface of the helmet shell than the outer surfaces of the pad structures, whereby the liner may be inserted in the helmet shell and reduce the transmission of sound within the helmet shell.

12. The protective helmet of claim 11, wherein the sound deadening material is a plastic material.

13. The protective helmet of claim 12, wherein the plastic material is a plastic foam material.

14. The protective helmet of claim 13, wherein the plastic foam material is a closed cell plastic foam material.

15. The protective helmet of claim 14, wherein the closed cell plastic foam material is cross-linked polyethylene.

16. The protective helmet of claim 11, wherein the at least one sheet of sound deadening material has a plurality of raised projections on its upper surface.

17. The protective helmet of claim 16, wherein each projection is spaced from adjacent projections and separated therefrom by a portion of the at least one sheet having a reduced thickness, and the sheet of material may be flexed and bent along the reduced thickness portions of the sheet, whereby the liner readily conforms to, and fits within, the spaces between the pad structures.

18. The protective helmet of claim 17 wherein the liner is formed of a single, integral sheet of sound deadening material.

19. The protective helmet of claim 11, wherein the at least one sheet of sound deadening material includes at least one positioning member extending outwardly from the peripheral surface, the at least one positioning member adapted to be disposed between some of the pad structures to position the liner within the protective helmet.

20. The protective helmet of claim 19, wherein there are three peripheral positioning members.

* * * * *